US005760327A

United States Patent [19]

Alexander

[11] Patent Number: 5,760,327

[45] Date of Patent: Jun. 2, 1998

[54] SUPERCONDUCTING RADAR DECOYS AND CAMOUFLAGE

[75] Inventor: Michael N. Alexander, Lexington, Mass.

[73] Assignee: The United States of America as represented by the Secretary of the Air Force, Washington, D.C.

[21] Appl. No.: 319,442

[22] Filed: Oct. 4, 1994

[51] Int. Cl.[6] ..... F41H 3/00

[52] U.S. Cl. ..... 89/1.11; 89/36.01; 342/14

[58] Field of Search ..... 89/36.01, 1.11; 342/14, 12

[56] References Cited

U.S. PATENT DOCUMENTS

| | | | |
|---|---|---|---|
| H308 | 7/1987 | Tutin et al. | 342/4 |
| 4,359,737 | 11/1982 | Bond | 343/18 A |
| 4,406,227 | 9/1983 | Beeker et al. | 102/505 |
| 4,456,912 | 6/1984 | Ensley | 330/4 |
| 4,606,848 | 8/1986 | Bond | 252/511 |
| 4,695,841 | 9/1987 | Billard | 342/8 |
| 4,700,190 | 10/1987 | Harrington | 342/2 |
| 4,884,076 | 11/1989 | Schneeberger et al. | 342/5 |
| 4,942,090 | 7/1990 | Morin | 428/367 |
| 5,105,200 | 4/1992 | Koepf | 343/700 MS |
| 5,455,594 | 10/1995 | Blasing et al. | 343/909 |

*Primary Examiner*—Stephen M. Johnson
*Attorney, Agent, or Firm*—Stanton E. Collier

[57] ABSTRACT

A high temperature superconducting material is incorporated onto a vehicle for the purpose of reflecting electromagnetic waves while superconducting. The vehicle may be chaff, a decoy, an electronic pod, a satellite, or a space vehicle. Heating and/or cooling is used to control the superconductivity state of the material. By selective use of the material and the substrate to which it is attached, the radar as well as the IR signatures can be altered.

3 Claims, 2 Drawing Sheets

SUPERCONDUCTING RADAR DECOYS AND CAMOUFLAGE

STATEMENT OF GOVERNMENT INTEREST

The invention described herein may be manufactured and used by or for the Government for governmental purposes without the payment of any royalty thereon.

BACKGROUND OF THE INVENTION (U)

The present invention relates to articles of warfare, and, in particular, relates to decoys and camouflage of these articles.

The use of reflected electromagnetic signals to detect objects is very well known. Further, the use of decoys to present false targets and camouflage to hide real targets is well developed. The following U.S. Patents present some of the technology in the area and are incorporated by reference: U.S. Pat. Nos. 4,359,737; 4,906,227; 4,606,898, 9,695,841; 4,700,190; 4,884,076 and 4,942,090.

For example, chaff can be used in both manners depending on the application. A small area looks like a target while a large area can hide a target. Chaff is typically made of metal strips cut into lengths determined by the intended spectrum. The metal can be applied on a plastic or other substrate to provide additional support. The use of metal or metal alloys is not temperature dependent.

SUMMARY OF THE INVENTION (U)

The present invention uses high temperature superconducting material to alter the radar and infrared, for example, signatures of aircraft or other objects.

In one embodiment chaff is made from high temperature superconducting material. The chaff can be made of material having different transitional temperatures. By cooling the chaff well below this temperature, a sufficient period of time(s) exists when the chaff will present a highly reflective target before becoming resistive as it becomes warmer.

In another embodiment, the high temperature superconducting material is applied to the surface of objects. An applied coolant can be used to turn the surface into a superconducting surface. If this object is in outer space, the dark side will be superconducting unless heated and the light side resistive unless cooled.

Therefore, one object of the present invention is to provide uses for high temperature superconducting materials in warfare objects where its features of superconducting can be used.

Another object of the present invention is to provide materials having different characteristics which are time dependent for use in warfare objects.

These and many other objects and advantages of the present invention will be readily apparent to one skilled in the pertinent art from the following detailed description of a preferred embodiment of the invention and the related drawings.

BRIEF DESCRIPTION OF THE DRAWINGS (U)

DETAILED DESCRIPTION OF THE PREFERRED EMBODIMENT (U)

Figure 1A:
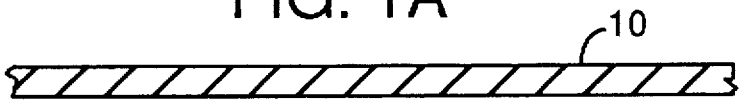
FIGS. 1A & 1B illustrates the chaff of the present invention.
Figure 1B:
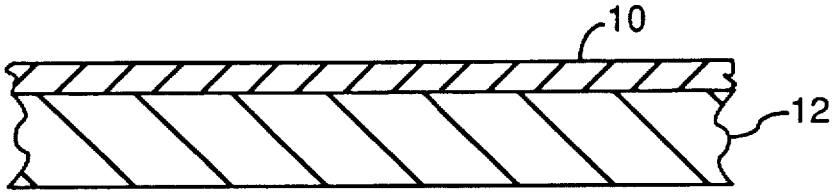
Figure 3:
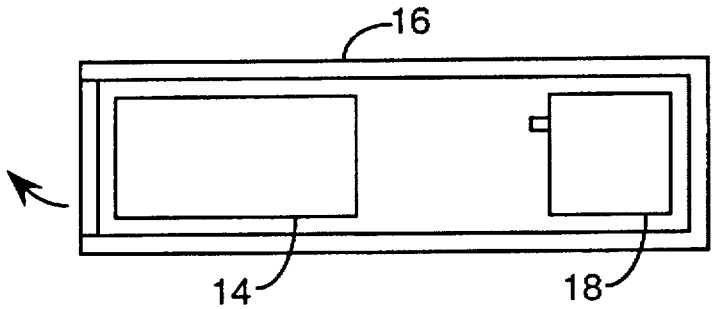
FIG. 3 illustrates a means for chaff deployment.

Referring to FIG. 1A, a high temperature superconducting material such as the layered cuprates, eg. $YB_{60}$ Cu $O_{7-x}$ where X<1, is formed into a chaff strip 10. If a stronger support is required, FIG. 1B shows the strip 10 applied to a substrate 12 which may be plastic. The thermal mass of substrate 12 may be large and can be used to control how fast the layer 10 warms. This chaff may be cut into different lengths as well as being made of different material having different transition temperatures. Typical superconducting materials upon heating above the transition temperature, Tc, become "normal" metals and thus still very reflective, but the high temperature superconducting materials act as "poor" metals and thus do not reflect as much. These strips 10 can be packaged in a canister 14, FIG. 3, in a conventional carrier 16 with a coolant supply 18 added. Before release, the coolant such as liquid nitrogen would cool the strips 10 below their transition temperature. The strips 10 could be released as a target/decoy or as a means of camouflage.

In the superconducting state, the material would be highly reflective of either passive or active radiation. Further, the infrared signature could be altered as the material changes temperature.

This invention permits new flexibility in the design of chaff and decoy properties. If, for example, one mixes chaff of different sizes, thermal masses, thus creating different rates at which the material warms up, and/or if the chaff is composed of more than one kind of superconducting material (thus having more than one transition temperature), it would be possible to design time dependences into the radar/IR cross section of the chaff. Moreover, the normal-state electrical conductivity of the newly discovered high temperature superconducting materials is much lower than the conductivity of metals like copper and aluminum, potentially offering chaff and decoy designers an additional variable.

In another embodiment, the high temperature superconducting material may be coated onto a substrate 20 to form a layer 22.

Figure 2A:
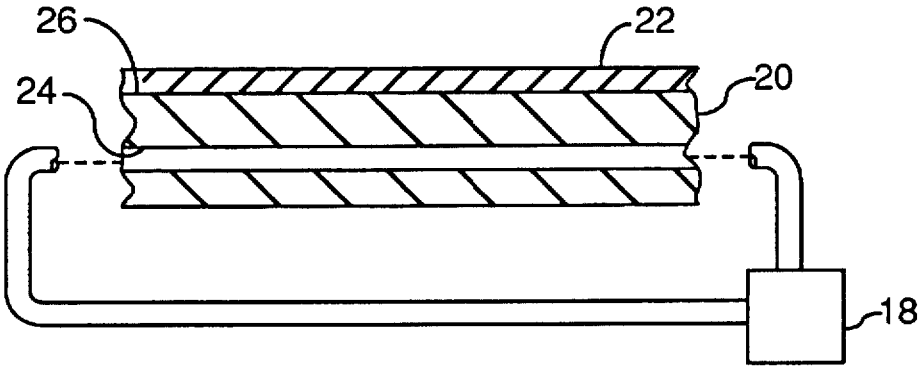
FIGS. 2A & 2B illustrate different means to cool a layer on a surface.
Figure 2B:
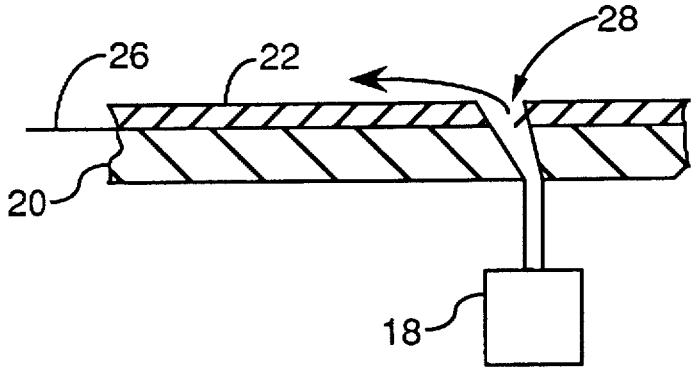

In FIG. 2A, a coolant supply 18 circulates a coolant through a passage 24 close to a surface 26 of the substrate 20. In this manner, the material layer 22 may be made superconducting as desired. Because of the circulating fluid, this operation could be carried out over a longer period of time. As seen in FIG. 2B, the coolant is output through the orifices 28 from a channel 32 connected thereto and would flow over the superconducting material layer 22. This configuration would weigh less than that shown in FIG. 2A. By controlling the output, the radar/IR cross section signature can be made to change as a function of time.

Figure 4:
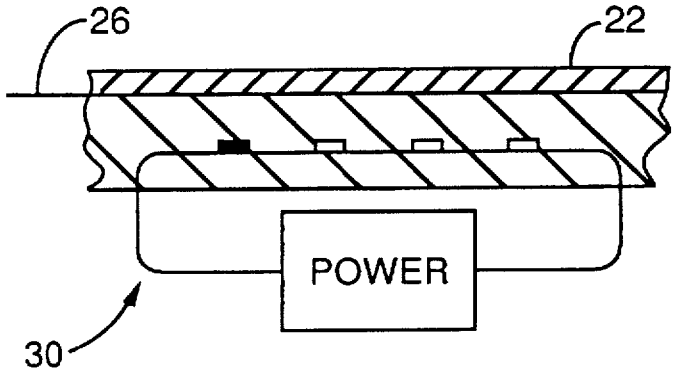
FIG. 4 illustrates a material layer of high temperature superconducting material with a heating means thereon.

A variation of the latter embodiment could be applied to a spacecraft. "Ambient temperature" for the shaded side of a satellite or a spacecraft is below the transition temperature of some of the new high temperature superconductor materials. Thus the reflectivity of superconductor materials on the shaded side could be controlled by heating elements or by changing the attitude of the spacecraft. FIG. 4 shows the material layer on a substrate 20 having a heating means 30 embedded close to surface 26. On the sunlit side, cooling would be required shown above to remain superconducting.

Clearly, many modifications and variations of the sent invention are possible in light of the above teachings it is therefore understood, that within the inventive scope the inventive concept, the invention may be practiced otherwise than specifically claimed.

What is claimed is:

1. A device, said device being composite layers of material for changing the electromagnetic signature of a vehicle, said device reflecting electromagnetic energy while superconducting, said layers for use on said vehicle, said layers comprising: a high temperature superconducting material forming an outside layer; a substrate being an inside layer, said substrate having said outside layer of material thereon, said substrate having channels therein close to said outside layer; and a cooling means, said cooling means inputting a fluid into said channels to cause said outside layer to become superconductivity upon command.

2. A layers as defined in claim 1 wherein said vehicle is selected from the group consisting of decoys, electronic pods, satellites, and spacecraft.

3. A layers as defined in claim 1 wherein said outside layer has a plurality of orifices for outputting coolant being said fluid onto said material.

* * * * *